United States Patent [19]

Allen

[11] Patent Number: 4,852,918

[45] Date of Patent: Aug. 1, 1989

[54] ADJUSTABLE LATCH BOLT MECHANISM

[75] Inventor: Charles H. Allen, Clifton Springs, N.Y.

[73] Assignee: Doris L. Davie, Geneva, N.Y. ; a part interest

[21] Appl. No.: 147,813

[22] Filed: Jan. 22, 1988

[51] Int. Cl.[4] ..... E05C 1/16

[52] U.S. Cl. ..... 292/169; 292/244; 292/DIG. 60

[58] Field of Search ..... 292/137, 169, 244, 341.18, 292/341.19, DIG. 60, 169.22, 169.21

[56] References Cited

U.S. PATENT DOCUMENTS

| | | | |
|---|---|---|---|
| 293,424 | 2/1884 | Copeland et al. | 292/163 X |
| 1,541,093 | 6/1925 | Amico | 292/150 |
| 1,759,375 | 5/1930 | Schlage | 292/169.22 |
| 2,231,414 | 2/1941 | Model | 292/341.18 |
| 3,097,873 | 7/1963 | Casebolt | 292/244 |

*Primary Examiner*—Richard E. Moore

*Attorney, Agent, or Firm*—Cumpston & Shaw

[57] ABSTRACT

An adjustable latch bolt mechanism is mountable on a door for aligning a latch bolt with an opening in a strike plate on a facing door jamb. The latch bolt mechanism comprises a latch body movable in one direction to a normal extended position causing a latch bolt supported by and slidably mounted at one end of the latch body to engage the opening in the strike plate. A coupling mechanism couples the latch bolt to the latch body for slidably adjusting the latch bolt for movement in a direction transverse to the one direction to a selected position in which the latch bolt is in alignment with the strike plate opening.

7 Claims, 2 Drawing Sheets

ADJUSTABLE LATCH BOLT MECHANISM

FIELD OF THE INVENTION

The present invention relates generally to door latches, and more particularly to an adjustable latch bolt mechanism for vertically adjusting the latch bolt when the mechanism is mounted on a door so that the latch bolt is in alignment with an opening in a strike plate.

BACKGROUND OF THE INVENTION

Residential and industrial buildings have vertically mounted doors that have door locks, passage door latch sets or dead bolts, all of which normally include a reciprocally movable latch bolt mountable on the door for engaging an opening in a strike plate on the facing door jamb. The latch bolt is biased by a spring to a normal extended position for engaging the opening in the strike plate. As the foundations for the building settle, the latch bolt and complementary strike plate opening move vertically relative to one another and become misaligned. In such instances, the latch bolt may be displaced sufficiently from its aligned position so that it will not engage the opening in the strike plate.

At the present time, this problem of misalignment is overcome by removing the strike plate from its recess in the door jamb and chiseling or morticing the recess at the upper or lower end thereof. The strike plate is replaced in the enlarged recess and moved vertically up or down until the strike plate opening is once again in alignment with the latch bolt. In this aligned position, the strike plate is resecured to the door. This known way of realigning the latch bolt with the opening in the strike plate has the following disadvantages:

One disadvantage is that the morticed or cut-out recess receiving the strike plate in the door jamb must be enlarged above or below the strike plate to allow vertical adjustment of the strike plate within the cut-out portion. This is aesthetically unacceptable, requiring the application of a wood filler to the cut-out portion above or below the strike plate after it is replaced.

Another disadvantage is that the screw openings in the reinstalled strike plate no longer align with the complementary screw openings in the wood door jamb. To work properly, the screw openings in the door jamb have to be filled and new openings provided only a few thousandths of an inch from the old openings. This is time consuming and the results are not always satisfactory, since the screws tend to follow the old screw hole and return the strike plate to its initial misaligned condition.

Still another disadvantage with the aforementioned type of solution to the misalignment problem is that the opening in the wood door jamb in register with the strike plate opening is now misaligned. A small chisel or the like is required to enlarge the opening in the door jamb which would otherwise block the latch bolt from entering the door jamb opening after it has passed through the strike plate opening. Accordingly, it is evident that the presently known solution to this misalignment problem is time consuming, unreliable and generally unsatisfactory.

SUMMARY OF THE INVENTION

An object of this invention is accomplished by providing an adjustable latch bolt mechanism mountable on a door for aligning a latch bolt with an opening in a strike place on a facing door jamb, comprising:

a latch body movable in one direction toward the strike plate opening;

a latch bolt supported by and slidably mounted on the latch body for movement along with the latch body in the one direction; and means coupling the latch bolt to the latch body for slidably moving the latch bolt relative to the latch body in the transverse direction to a selected position in which the latch bolt is in alignment with the strike plate opening.

A more specific object of the present invention is accomplished by providing an adjustable latch bolt mechanism wherein the latch body comprises a U-shaped frame member having a partially closed end and parallel arms;

wherein the partially closed end has an opening extending therethrough to define a pair of spaced side rails;

wherein the latch bolt has grooves on opposite sides thereof for slidably receiving the side rails;

wherein a cross bar is secured between the arms parallel to and spaced from the partially closed end;

wherein the latch bolt has a notch facing the cross-bar; and wherein the coupling means comprises a stub shaft having one end rotatably supported by the cross bar, a circular cam mounted within the notch, the cam having one side thereof eccentrically secured to the opposite end of the stub shaft, and a recess on the opposite side of the cam; and wherein the latch bolt has an opening extending therethrough parallel to the one direction and in alignment with the recess through which a tool is insertable into engagement with the recess for rotating the eccentrically mounted cam for moving the latch bolt in the transverse direction.

BRIEF DESCRIPTION OF THE DRAWINGS

In the detailed description of the invention presented below, reference is made to the accompanying drawings, in which.

DETAILED DESCRIPTION OF THE INVENTION

Figure 1:
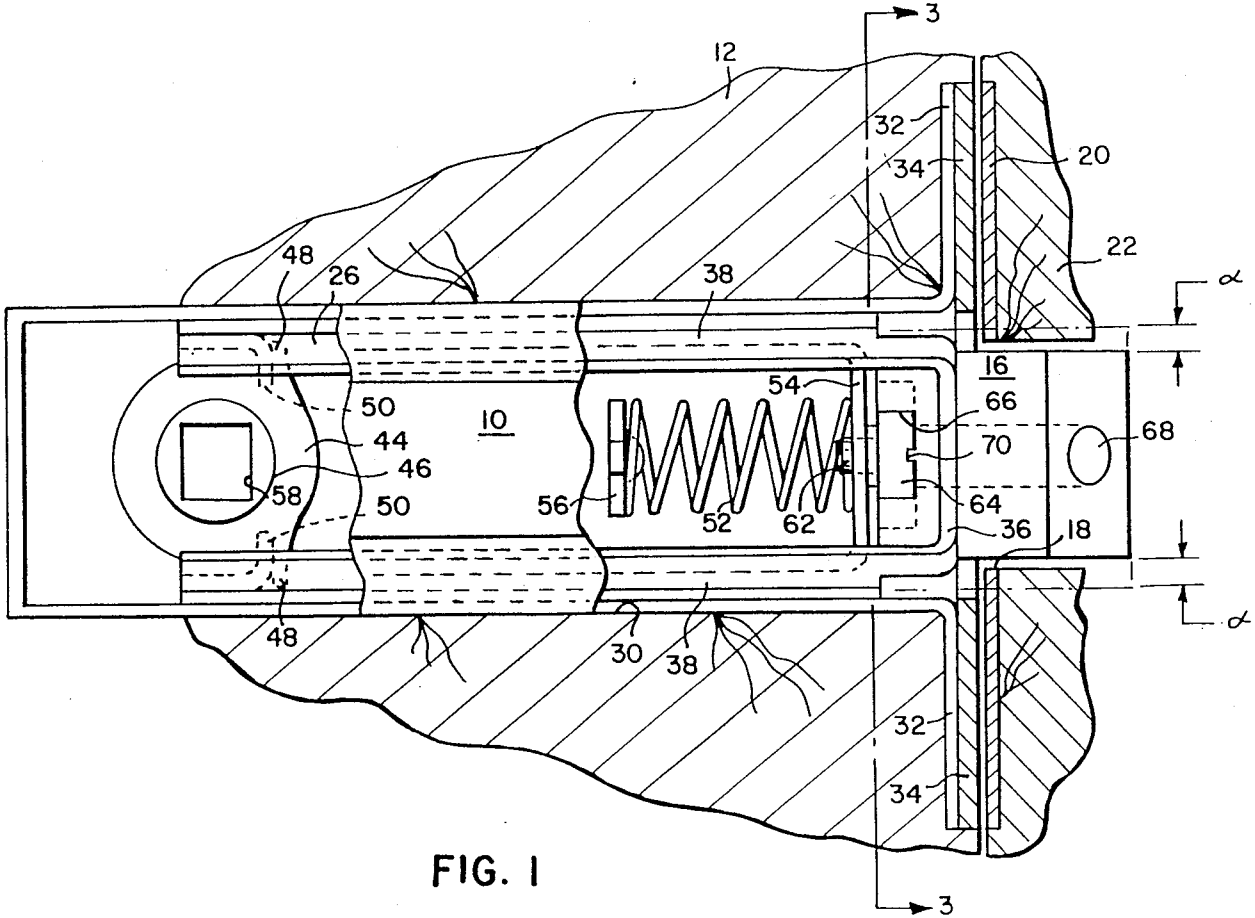
FIG. 1 is a side-elevational view of a preferred embodiment of an adjustable latch bolt mechanism of this invention, with portions of the side plate omitted for purposes of clarity.
Figure 2:
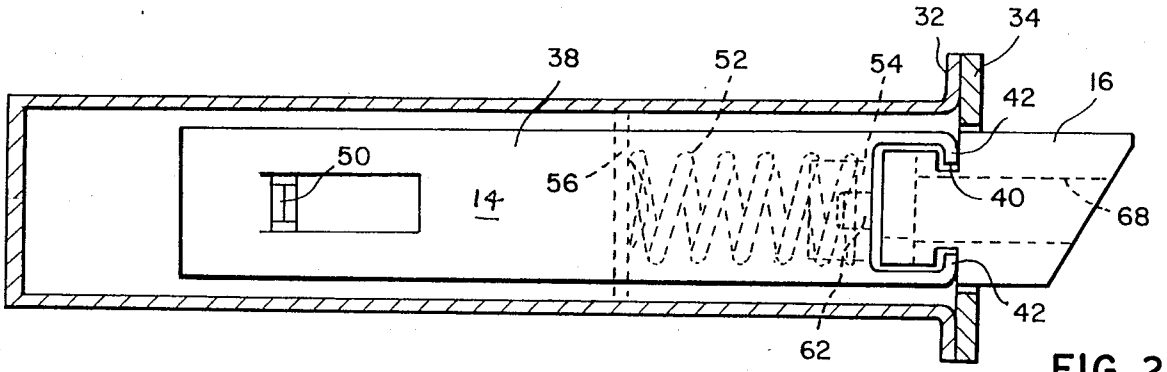
FIG. 2 is a top plan view of FIG. 1 with portions of the side plates omitted for purposes of clarity.
Figure 3:
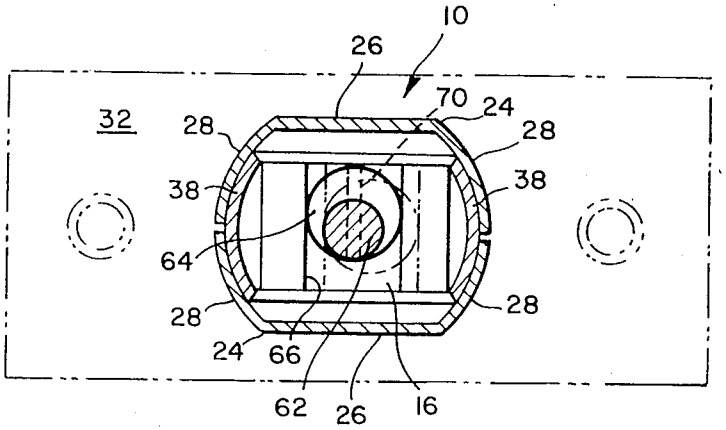
FIG. 3 is a section view of the adjustable latch mechanism of FIG. 1 taken substantially along line 3—3 of FIG. 1, with the door portion omitted for purposes of clarity.

With reference to FIGS. 1–3, a preferred embodiment of the adjustable latch bolt mechanism of this invention comprises a barrel housing 10 mounted within an edge portion 12 of a door, as is well known in the art. The latch bolt mechanism further has a latch body 14 slidably mounted within housing 10 for reciprocal movement in one direction toward a strike plate 20 on a door jamb 22 facing edge portion 12 of the door. A latch bolt 16 extends from edge portion 12 of the door, and is supported by and slidably mounted on latch body 14 for movement along with the latch body in the one direction, and for movement in a direction transverse to the one direction. Means are provided coupling latch bolt 16 to latch body 14 for slidably moving the latch bolt in the transverse direction to a selected adjusted position in which the latch bolt is in alignment with an opening 18 in a strike plate 20.

The barrel housing 10 is best seen in cross section in FIG. 3, and comprises a pair of mating sections 24 of U-shaped cross section, each section having a flat base 26 and curved laterally extending mating side portions 28. The housing 10 is inserted within an opening 30 in the door extending inwardly from a side edge of the door. The housing 10 has a laterally extending flange 32 and a cover plate 34 that are recessed within a cut-out in the side edge of the door and secured thereto by screws, (not shown) as is well known in the art.

The latch body 14 comprises a U-shaped frame member having a partially closed end portion 36 and a pair of laterally extending, spaced-apart parallel arms 38. Each arm has a curved cross section that slidably nests within the curved side portions 28 of housing 10, as best seen in FIG. 3. The closed end portion 36 has an opening 40 extending therethrough, as best seen in FIG. 2, to form a pair of spaced-apart side rails 42. The latch body 14 is reciprocally movable within housing 10 from a normal latched position to an unlatched position by a known wheel member 44, (FIG. 1) having circular shoulders rotatably supported within opposed openings 46 in bases 26 of housing 10. The wheel member 44 has lugs 48 engagable with fingers 50 laterally extending from arms 38. A spring 52 is interposed between a cross bar 54 and a flange 56. Cross bar 54 extends between arms 38 and flange 56, which is secured to and laterally extends from a housing base 26. The spring 52 biases the fingers against the lugs for holding the latch bolt in its latched extended position. The bolt 16 is moved to its unlatched position by door knobs, not shown, secured to a square shaft, not shown, which extends through a square opening 58 in wheel member 44. Movement of the door knobs in either direction causes the door lugs 48 to retract the latch body 44 and latch bolt 16 against the bias of spring 52 for opening the door, as is well known in the art.

The latch bolt 16 extends outwardly in the one direction from the side edge of the door, and comprises a unitary member having grooves 59 for slidably receiving side rails 42 of closed end portion 36 of the latch body. The latch bolt has an inclined face 60 which is adapted to engage an edge of strike plate 20 when the hinged door, not shown, is closed relative to door jamb 22. The strike plate 20 cams latch bolt 16 rearwardly against the bias of spring 52 until the leading edge of the latch bolt is moved into alignment with latch bolt opening 18 in strike plate 20, whereupon spring 52 biases the latch bolt to its extended position into engagement with strike plate opening 18 for latching the door to jamb 22. If the upper and lower surfaces of latch bolt 16 properly align with the upper and lower edges of strike plate opening 18 the latch bolt will enter the opening. However, if misalignment occurs between latch bolt 16 and strike plate 20 such that one of the edges of the latch bolt is not in proper alignment with the corresponding edge of strike plate opening 18, interference will occur between the latch bolt and the strike plate opening preventing the latch bolt from entering the opening.

To overcome the aforementioned misalignment problem of latch bolt 16 and strike plate opening 18, coupling means are provided for coupling the latch bolt to latch body 14. The coupling means slidably moves latch bolt 16 in the transverse direction, by virtue of side rails 42 and grooves 59, to a selected adjusted position, in which the latch bolt is in complete alignment with strike plate opening 18 and will enter therein.

The coupling means comprises a stub shaft 62 journaled for rotation within cross bar 54. A cam comprising a circular cam wheel 64 has one side thereof eccentrically secured to stub shaft 62. The cam wheel 64 is mountable within a notch 66 on the rear surface of latch bolt 16. The latch bolt has an elongated access opening 68 extending from inclined surface 60 through notch 66 into alignment with a screwdriver recess 70 on the opposite side of cam wheel 64 that is accessible by a screwdriver extending through opening 68. Accordingly, a misalignment between latch bolt 16 and strike plate opening 18 is corrected merely by inserting the screwdriver through opening 68 into engagement with recess 70 in cam wheel 64, which upon rotation thereof adjustably moves latch bolt 16 up or down. The screwdriver is turned until the upper and lower edge surfaces of bolt 16 are aligned between the upper and lower edges of strike plate opening 18 so the latch bolt will be moved by spring 52 to its latched extended position within strike plate opening 18 when the door is closed. The latch bolt 16 is held in its adjusted position by friction between the surface of cam wheel 64 and notch 66, and between stub shaft 62 and cross-bar 54. Additionally, a serrated plate, not shown, with spring tension can be mounted in pressing engagement with stub shaft 62 for releasably holding latch bolt 16 in its adjusted position.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An adjustable latch bolt mechanism mountable on a door for aligning a latch bolt with a strike plate opening in a strike plate on a facing door jamb, comprising:

a latch body reciprocally movable in one direction toward the strike plate opening;

a latch bolt supported by and mounted at an end of the latch body for movement in the one direction for engaging the strike plate; and means coupling the latch bolt to the latch body for moving the latch bolt relative to the latch body in a transverse direction to a selected adjusted position in which the latch bolt is in alignment with the strike plate opening.

2. An adjustable latch bolt mechanism according to claim 1, wherein the coupling means comprises a notch in the latch bolt, and an eccentric cam rotatably mounted on the latch body and insertable within the notch for slidably moving the latch bolt upon rotation of the eccentric cam.

3. An adjustable latch bolt mechanism according to claim 2, wherein the eccentric cam has a recess therein, and the latch bolt has an opening aligned with the recess through which a tool is insertable into engagement with the recess for rotating the eccentric cam.

4. An adjustable latch bolt mechanism according to claim 3, and further comprising a hollow housing secured to a door, the latch body is slidably mounted within the housing, and a spring interposed between the housing and latch body for normally biasing the latch body in the one direction and the latch bolt into the strike plate opening.

5. An adjustable latch bolt mechanism according to claim 1, wherein the latch body comprises a U-shaped frame member having a partially closed end and parallel arms; wherein the closed end has an opening extending therethrough to define a pair of spaced side rails; wherein the latch bolt has grooves on opposite sides thereof for slidably receiving the side rails; wherein a cross-bar is secured between the arms parallel to and spaced from the closed end; wherein the latch bolt has a notch facing the cross-bar; and wherein the coupling means comprises a circular cam mounted within the notch, the cam having an eccentric stub shaft laterally extending from one side thereof and journaled in the cross-bar whereby rotation of the stub shaft rotates the cam and moves the latch bolt in the transverse direction.

6. An adjustable latch bolt mechanism according to claim 5, wherein the cam has a recess on the opposite side thereof, and wherein the latch bolt has an opening extending therethrough in alignment with the recess in which a tool is insertable into engagement with the recess for rotating the eccentrically mounted cam.

7. An adjustable latch bolt mechanism according to claim 6, and further comprising a hollow housing secured to a door, the latch body is slidably mounted within the housing, and a spring is interposed between the housing and latch body for normally biasing the latch body in the one direction and the latch bolt into the strike plate opening.

* * * * *